US006123021A

United States Patent [19]

Cameron

[11] Patent Number: 6,123,021

[45] Date of Patent: Sep. 26, 2000

[54] MULTIPLE COLOR PRINTER FOR PRINTING ON SMALL OBJECTS

[76] Inventor: Robert Cameron, 3245 S. Bellwood La., Glenview, Ill. 60025

[21] Appl. No.: 09/207,804

[22] Filed: Dec. 9, 1998

[51] Int. Cl.[7] ..... B41F 17/00

[52] U.S. Cl. ..... 101/41; 101/163

[58] Field of Search ..... 101/35, 41, 42, 101/43, 44, 150, 163, 167, 169, 170

[56] References Cited

U.S. PATENT DOCUMENTS

| | | | |
|---|---|---|---|
| 3,916,784 | 11/1975 | Dubuit | 101/41 |
| 4,811,662 | 3/1989 | Sterman | 101/170 |
| 5,664,496 | 9/1997 | Scheuhing et al. | 101/169 |

FOREIGN PATENT DOCUMENTS

| | | | |
|---|---|---|---|
| 0424716 | 5/1991 | European Pat. Off. | 101/163 |
| 3608125 | 9/1987 | Germany . | |
| 2171645 | 9/1986 | United Kingdom | 101/163 |

*Primary Examiner*—Edgar Burr
*Assistant Examiner*—Amanda B. Sandusky
*Attorney, Agent, or Firm*—Robert L. Marsh

[57] ABSTRACT

A machine for printing a plurality of colored patterns on the surface of a contact lens has a plurality of parallel oriented print stations each of which has an image die and an ink cup for applying ink into the image in the die. A slide is moveable between a plurality of the print stations such that a contact lens on the slide can receive printing at each of the stations. The slide also carries a vertically moveable print pad for applying printing to a lens and an indexing cleaning tape for cleaning the print pad.

13 Claims, 5 Drawing Sheets

MULTIPLE COLOR PRINTER FOR PRINTING ON SMALL OBJECTS

The present invention relates to a device for printing coloring on contact lens and in particular to a device for printing a plurality of colors on one lens, or for simultaneously printing coloring on a plurality of lens.

BACKGROUND OF THE INVENTION

Coloring can be applied to the surface of contact lens to alter the coloring of the eyes of the person wearing the lens. The coloring of the pupil of the human eye is, however, very complex. The center of the pupil has a deep, almost black, solid color, while the outer periphery of the pupil has a lighter, distinguishable color such as brown, hazel, blue, green, or some blend thereof. The outer periphery of the pupil, however, is not uniform in color. It may be deeper near the outer edges of the pupil than near the center, and the coloring may be a composition with a background of one color broken by fine lines of a second color which extend radially inward from the outer circumference of the pupil. A combination of three or four colors, therefore, may be required to duplicate the coloring of the human eye. To print coloring on a contact lens which, when fitted into the eyes of a wearer, will change the coloring of the eyes of the wearer and not appear to be unnatural, must have a pattern of colors printed on the surface thereof which duplicates the pattern of the human eye.

To print a pattern having a plurality of colors onto a contact lens, the pattern must be broken down into subpatterns, with each subpattern corresponding to one of the colors which make up all of the colors in the pattern. The subpatterns must be aligned such that the printing of ink of one color does not overlay upon the ink of another color, because the multiple layering of the inks will create an uneven surface which can cause irritation in the eye of the wearer, and it will give an unnatural coloring to the pattern. Both of these consequences reduce the desirability of the contact lens to which the coloring has been applied.

Machines are currently available which apply a plurality of subpatterns of color to a contact lens and these machines use a carousal having a plurality of retainers thereon for retaining a lens. As the carousal rotates each lens retainer is moved from one coloring station to another with the pattern for a different coloring applied at each coloring station. Each of the stations includes a vertically moveable print pad and a first assembly for applying a subpattern of fresh ink to the print pad before the print pad is pressed against a contact lens and a second assembly for removing residue ink from the print pad after the pad has been used to apply ink to a contact lens. Each first assembly has an image die with a pattern therein which is moveable, or "doctored," to a first position at which ink is applied into the pattern of the die after which it is doctored to a second position below the print pad. The print pad is lowered and compressed against the image die and thereafter elevated, after which the ink from the image die is retained on the print pad. The image die is doctored back to the first position at which ink is reapplied. With the image die doctored out from under the print pad, the carousal can be rotated to move the lens retainer with a contact lens thereon beneath the print pad and the print pad is again lowered to apply ink to the surface of the contact lens. After the print pad is again raised, an incremental rotation of the carousal will then move the retainer and contact with printed material thereon towards its next stage. Residue ink on the print pad is removed by the movement of a cleaning table retaining a section of a three inch wide cellophane tape below the print pad and lowering the print pad against the adhesive of the tape. When the print pad is raised the role of cellophane tape is incrementally advanced to position a clean section of tape on the table and the cleaning table is moved out from below the print pad. The cycle is then repeated with the print pad moved downwardly for brief intervals to receive ink from the image die, to apply the ink to a contact lens, and to contact the adhesive of the tape to remove excess ink from the surface thereof.

Machines as described above will produce high quality colored lens with patterns printed thereon which duplicate the appearance of the pupil of the human eye, although such machines do have limitations. First, there are practical limitations to the size of the carousal and therefore there are limitations to the number of lens which can be simultaneously printed by such machines. Second, by the nature of their circular configuration, the machines have substantial space requirements. Third, the machine moves one of the three elements of image die, cleaning table, and contact lens container successively below the print pad and the speed at which the machine operates is limited by the speed at which the elements can be successively first moved under the print pad, and then be removed therefrom. It would therefore be desirable to provide a machine for applying multiple colors to contact lens which could carry out the steps of the printing process more rapidly to thereby provide a faster operating machine. Furthermore, it would be desirable to provide a machine having more economical space requirements such that more machines could be placed within a work site and thereby provide for increased productivity of a work site of a given size.

SUMMARY OF THE INVENTION

Briefly, the present invention is embodied in a machine for applying a plurality of inked patterns, each with a different color, to a contact lens to give the surface thereof the appearance of the pupil of a human eye. In accordance with the invention, the machine has a plurality of print stations in side-by-side relationship with a carriage which is moveable from one station to another. Where four colors are to be applied to a contact lens, the carriage is moveable across four color stations to thereby apply the four colors to the lens, and where fewer colors are required, the carriage is adapted to move to only the number of stations necessary to provide the required coloring. Each of the stations has a moveable image die having a planar horizontal surface with a pattern of indentations that are for receiving the coloring material which is usually an ink. The image die is horizontally moveable, for doctoring between a first position at which color is applied into the pattern of the die, to a second position in which it can be contacted by a print pad for transferring the ink thereto.

Mounted on the carriage is a retainer for retaining the contact lens and a cleaning table across which segments of tape are incrementally advanced.

Also mounted on the carriage is a gantry for retaining a vertically moveable print pad, and the gantry is horizontally moveable in a second direction perpendicular to the direction of movement of the carriage. When the carriage is positioned at a given print station, movement of the gantry in the second direction will successively position the print pad over the image die for the print station, the retainer on which the contact lens is retained, and the cleaning table across which the tape is advanced.

The movement of the carriage and the gantry are controlled by appropriate motor means, such as pneumatic cylinders. A first motor is provided to move the carriage from a first print station to a second print station, a second motor is provided to move the image die from its first position to a second position. A third motor moves the gantry to any one of three positions, the first position in which the print pad is over the image die, the second position in which the print pad is over the cleaning tape, and the third position in which the print pad is over the retainer for holding a contact lens. A fourth motor moves the print pad from an elevated position to a downward position to thereby apply the print pad successively against the image die, the contact lens, and the cleaning tape on the table.

Since the print pad is mounted on a moveable gantry the pad is repositioned for successive print pad operations by a single movement of the gantry. Existing machines, on the other hand, require two or more steps between successive operations of the print pad, one step to remove the completed operation from under the print pad, and a second step to move the next operation under the print pad. The speed at which existing machines can operate is limited by the multiplicity of steps required between successive operations of the print pad.

BRIEF DESCRIPTION OF THE DRAWINGS

A better understanding of the present invention will be had after a reading of the following descriptions taken in conjunction with the drawings wherein.

DETAILED DESCRIPTION OF A PREFERRED EMBODIMENT

Figure 1:
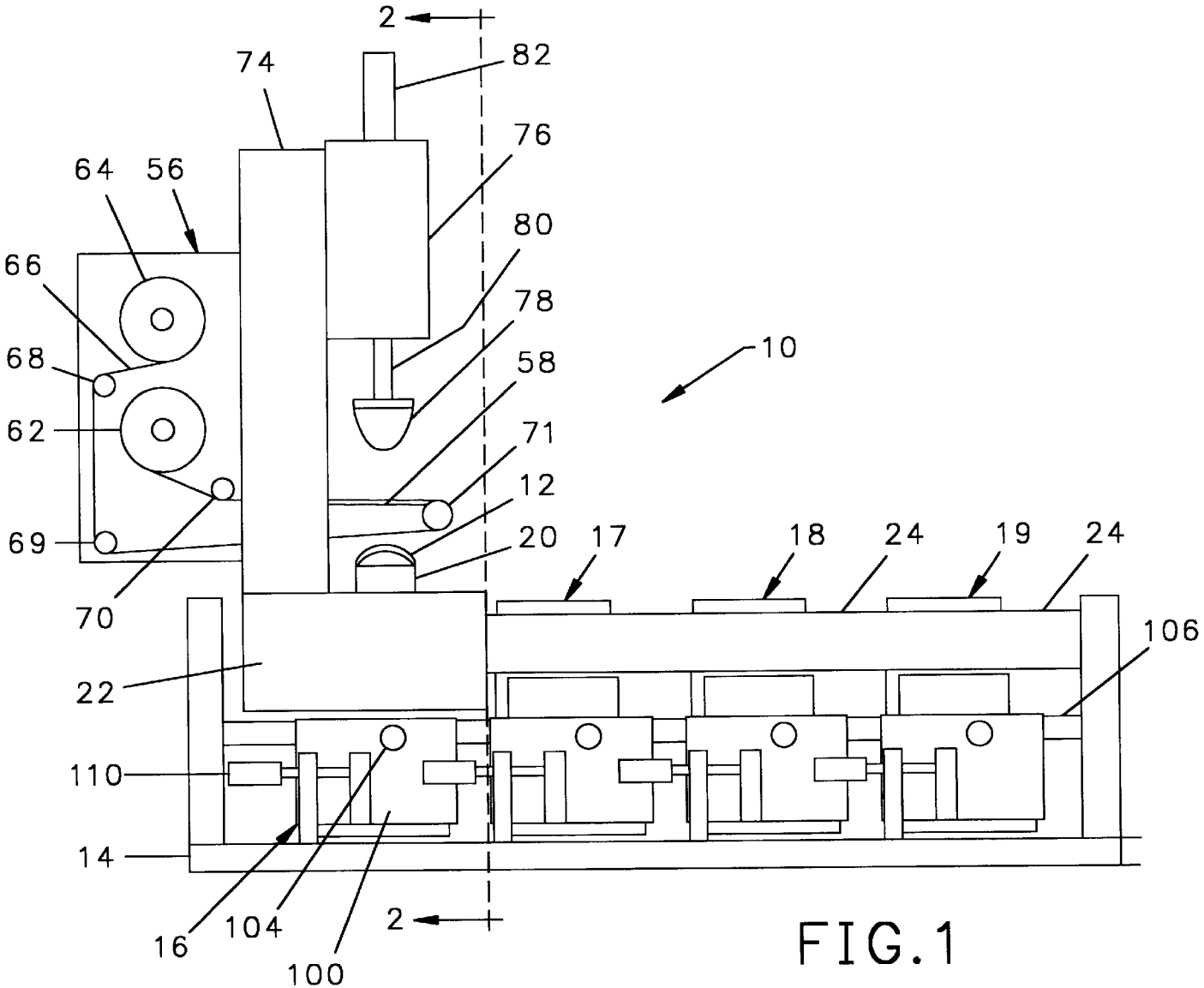
FIG. 1 is a front elevational view of a machine in accordance with the present invention.
Figure 2:
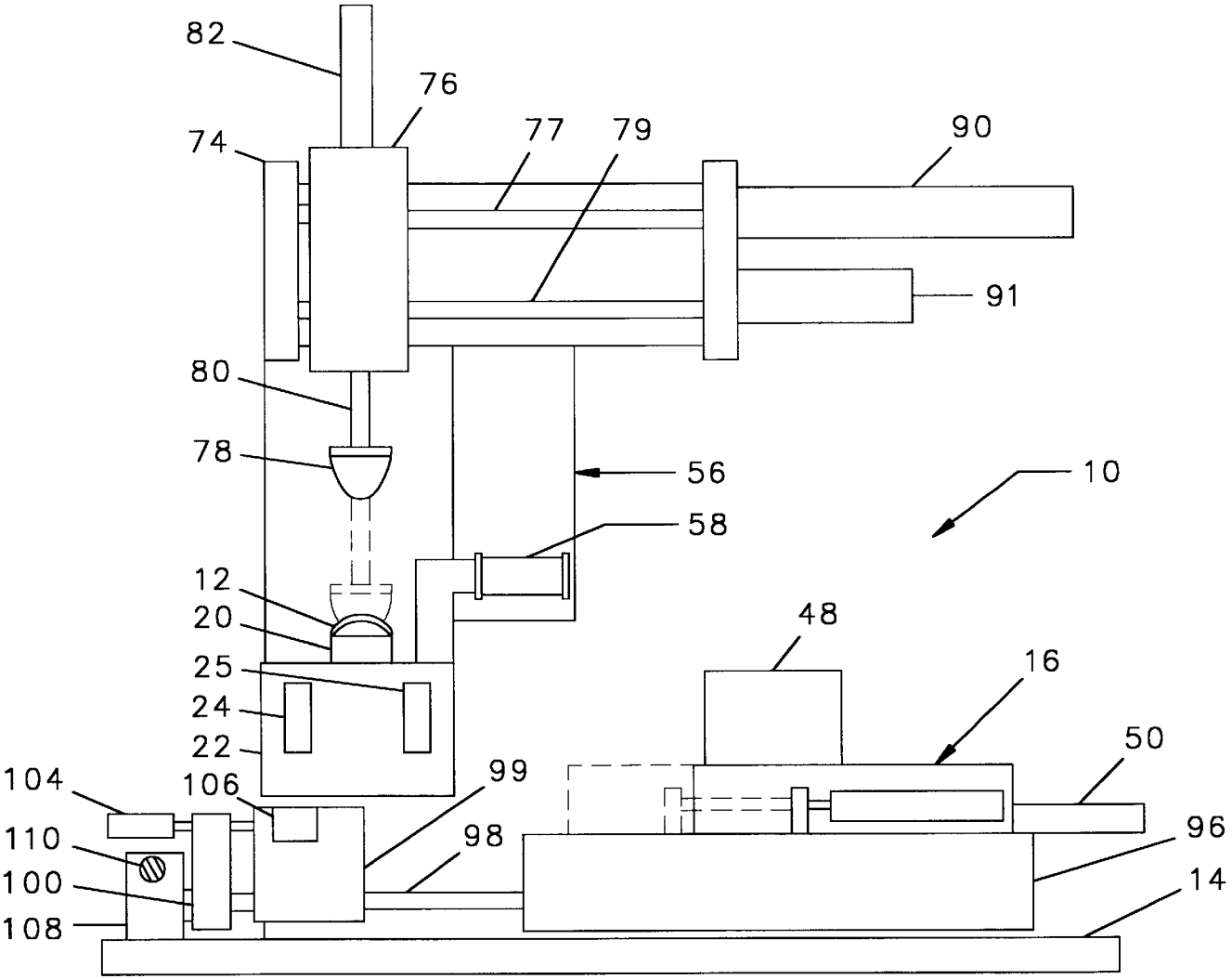
FIG. 2 is a cross sectional view of the machine shown in FIG. 1 taken through line 2—2 thereof.

Referring to FIG. 1 and 2 a printing machine 10 for printing the design of a pupil of an eye on a contact lens 12 has a base 14 on which are mounted a plurality of print stations 16, 17, 18, 19. Although the machine is depicted as having four print stations, it can be made with any number of print stations of which station 16 is representative of all such stations, and for the purposes of this description the elements common to all the stations will be described with respect to station 16.

To apply a plurality of colors to the lens 12, the lens is mounted on a lens retainer 20 of the type known in the art, and the retainer 20 is fixedly mounted on a linearly moveable carriage 22 for movement along rails 24, 25 such that the carriage 22 and the retainer 20 can be positioned to permit the lens 12 to receive printing from any of the print stations 16, 17, 18, 19. As depicted, the machine 10 can print a multi-colored pattern on the lens 12 having at least four colors, one from each of the print stations 16, 17, 18, 19. Alternately, the machine 10 can be configured to have up to four separate lens retainers 20, one adjacent to each of the print stations 16, 17, 18, 19, and the machine can print simultaneously print a pattern with a single color on four lenses 12.

Figure 6:
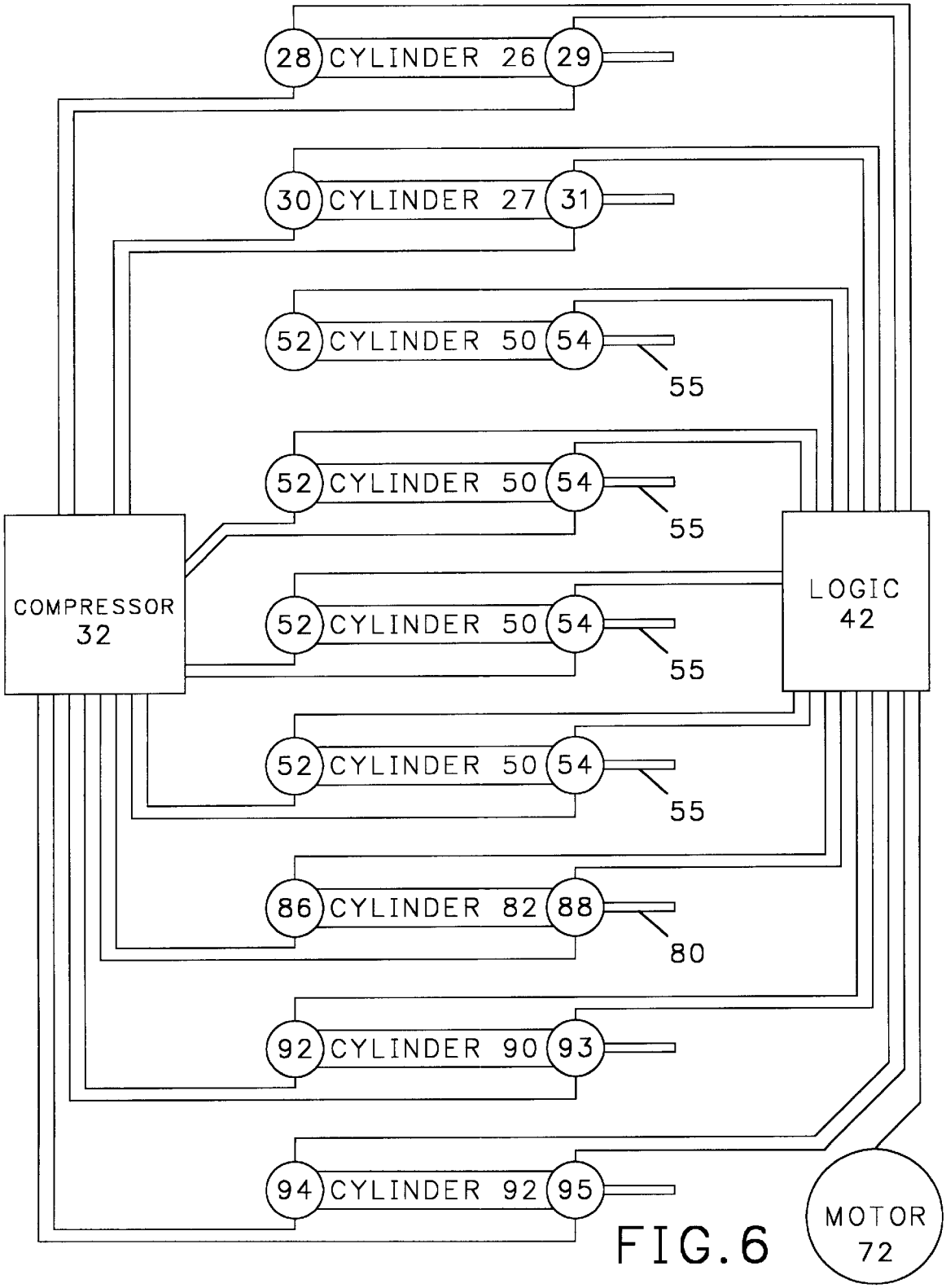
FIG. 6 is a block diagram of the electronic and pneumatic circuits for the machine shown in FIG. 1.

Referring to FIG. 1 and 6, movement of the carriage 22 along the rails 24, 25 is controlled by an appropriate motor such as a plurality of pneumatic cylinders, of which two 26, 27 are shown only in FIG. 6. The carriage 22 is depicted in FIG. 1 as being positioned to print an image on the contact lens 12 at print station 16, but can be moved to any one of the other stations 17, 18, 19 by operating the valves 28, 29, 30, 31 to direct compressed air from a source 32, such as a compressor. The sequencing of the opening and closing of the various valves is controlled by a logic means known in the art, such as a microprocessor 42.

Figure 3:
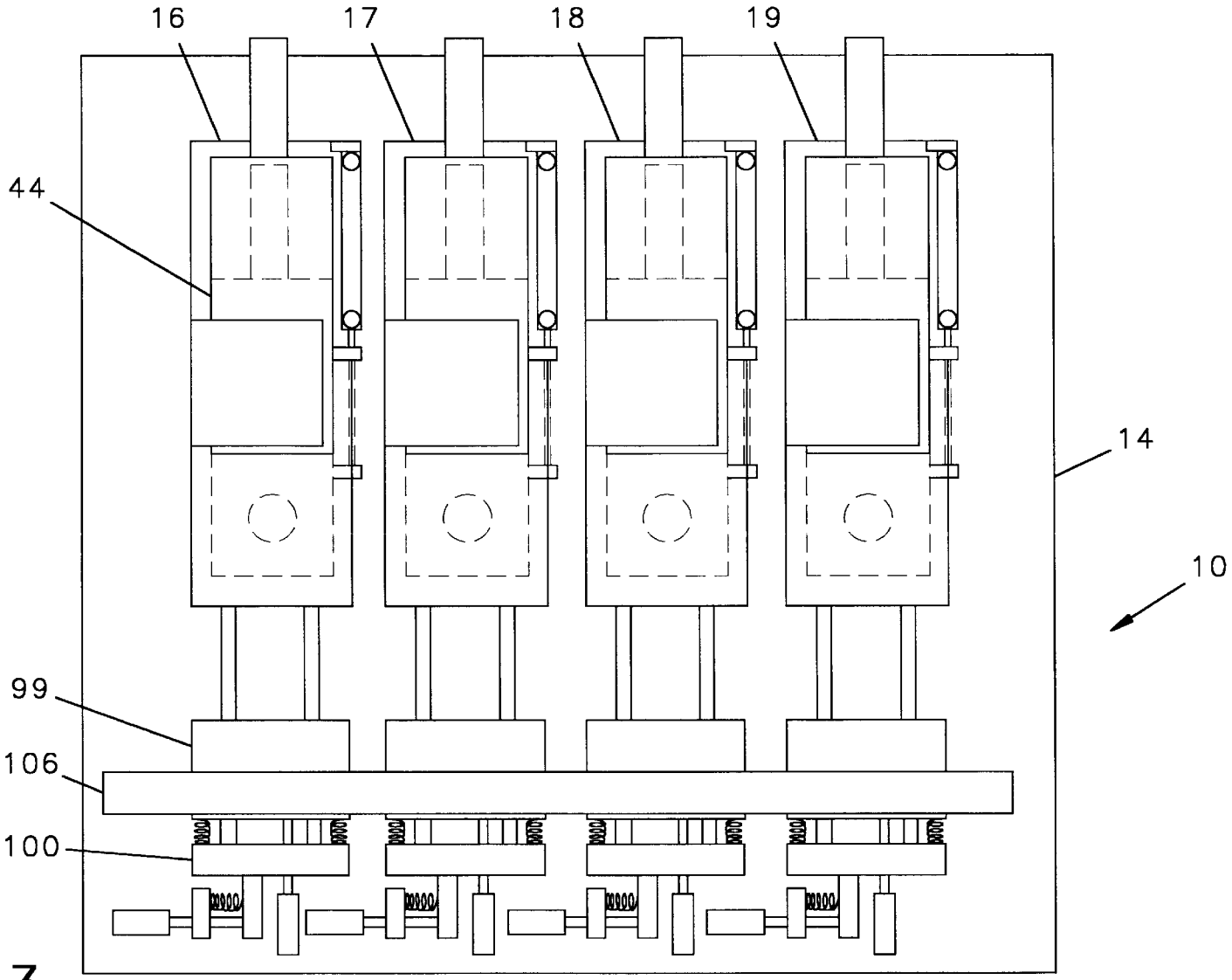
FIG. 3 is a top view of the machine shown in FIG. 1 with the gantry the carriage and the carriage tracks removed exposing the image dies and the moveable platforms on which the image dies are mounted.
Figure 5:
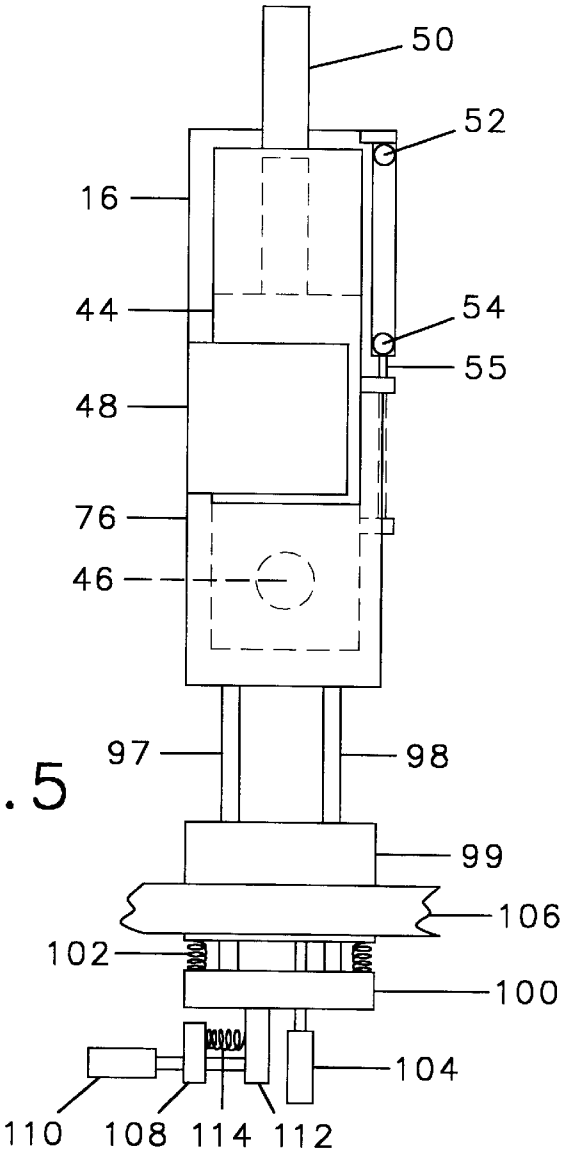
FIG. 5 is a fragmentary enlarged top view similar to that shown in FIG. 3 but showing a single image die and the micrometers for the positioning thereof.

Referring to FIG. 2, 3 and 5, print station 16 includes a moveable planar image die 44 having an image 46 etched in the upper surface thereof. The image die 44 is slideably moveable for a first position shown in solid lines in FIG. 3 and 5 wherein the image 46 is positioned below an ink cup 48 of the type known in the art for applying ink into the etchings of the image 46. Once ink has been applied into the etchings of the image 46, the image die is moved, or "doctored," to a second position shown as broken lines on FIG. 3 and 5 wherein the image 46 is exposed.

Referring to FIG. 5 and 6, movement of the image die 44 from the first position under the ink cup 48 to the second position shown in broken lines is caused by a pneumatic cylinder 50 which is moved as a result of compressed air being admitted through the appropriate valves 52, 54 thereof for either extending or retracting the associated shaft 55 to which the image die 44 is attached. Control of the valves 52, 54 is also carried out by the microprocessor 42.

In addition to the lens retainer 20, the carriage 22 has mounted thereon a cleaning assembly 56 having a horizontal table 58 across which a role of cleaning material, in the form of a cellophane tape, is incrementally advanced after each printing on the lens 12. As shown in FIG. 1 and 6, the cleaning assembly 56 includes a supply spool 62 and a take-up spool 64 with a length of tape 66 threaded across a plurality of idlers 68, 69, 70, 71 as it moves from the supply spool 62 across the upper surface of the table 58 to the take-up spool 64. An electric motor 72 which is also controlled by the micro processor 42, rotates the take-up spool 64 after each printing on the lens 12 thereby incrementally advancing the tape 66 across the upper surface of the table 58 to expose a clean portion of tape 66. The adhesive surface of the tape 66 is extended upwardly so that it will retain residual ink from the print pad during a cleaning step following each print on a contact lens.

Referring to FIGS. 1, 2, and 6, the carriage 22 further includes a gantry 74 having a slide 76 moveable along a pair of slide bars 77, 79 in a direction perpendicular to the movement of the carriage 22. Mounted on the slide 76 is a vertically moveable print pad 78 having a shaft 80 which is slideable within a cylinder 82 such that the print pad 78 is moveable from an elevated position shown as solid lines on FIG. 2 to a lowered position shown in broken lines. The vertical movement of the shaft 80 in the cylinder 82 is controlled by the associated valves 86, 88 which are also operated by the microprocessor 42.

Referring to FIGS. 2 and 6, the slide 76 is moved along the slide bars 77, 79 on the gantry 74 by a pair of cylinders 90, 91 having associated valves 92, 93, 94, 95 all of which are controlled by the microprocessor 42. The cylinders 90, 91 and the associated valves are configured to stop the slide at three fixed positions. In the first position the slide would be at the right hand end of the slide bars 77, 79, as viewed in FIG. 2 and the print pad 78 would be positioned above the image die when the image die 44 is in the second position as shown in broken lines in FIG. 3. When the slide 76 is in this position and the shaft 80 is momentarily extended to lower the print pad 78 to contact the upper surface of the image die 44, the ink in the image 46 will be transferred to the surface of the print pad. The slide 76 is then moved to a second position at the far left end of the slide as shown in FIG. 2, in which the print pad 78 is above the lens retainer 20. When the shaft 80 is again momentarily extended, the print pad 78 will contact the upper surface of the contact lens 12 and the ink on the lower surface of the print pad will then be applied to the upper surface of the contact lens. The slide 76 is then moved by the cylinders 90, 91 to the third over the cleaning table 58. The shaft 80 is again extended lowering the print pad 78 to contact the adhesive material on the tape 66 to thereby remove excess ink left on the surface of the print pad.

Referring to FIG. 6, after the print pad 78 has contacted the surface of the tape 66, the micro processor 42 will direct the motor 72 to rotate the take-up spool 64 and the tape 66 will incrementally advance a clean portion of tape across the table 58. Similarly, after the print pad 78 has momentarily contacted the upper surface of the image die 44, the micro processor 42 will operate the valves 52, 54 to move the image die 44 under the ink cup 48 where ink will again applied into the etching of the image 46. After ink has been applied into the etching 46 the microprocessor 42 again operates the valves 52, 54 to move the image die 44 to the second position where the upper surface thereof can be contacted by the print pad 78 when the second slide 76 is returned to the first position to repeat the print cycle.

After the lens 12 has received printing from the first print station 16, the microprocessor 42 will operate the valves 28, 29, 30, 31 for the cylinders 26, 27 to reposition the carriage 22 with the gantry 74 thereon before another of the print stations 17, 18, 19. The print cycle is thereafter repeated at the new print station where a print pattern of a second color is applied to the lens 12. It should be appreciated that since the print stations are linearly oriented, the machine 10 can be constructed to accommodate any number of print stations 16, 17, 18, 19 by merely extending the length of the machine. A machine accommodating any number of print stations can therefore be positioned on a shop floor and all the stations will be readily accessible for receiving a new lens 12 on the associated retainer 20. There is, therefore, no practical limitation to the size of the machine 10.

Figure 4:
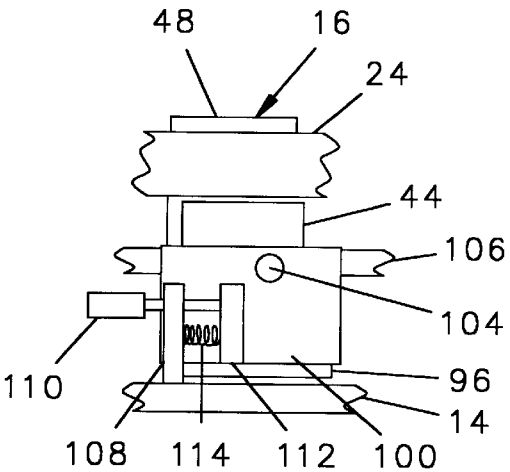
FIG. 4 is a fragmentary enlarged front view of the machine shown in FIG. 1 showing micrometers for positioning the image dies thereof.

Referring to FIGS. 4 and 5, to precisely position the application of ink to the lens 12 the image 46 in the die 44 must be precisely positioned with respect to the print pad 78. The die 44 is therefore mounted on a moveable platform 96. A pair of rods 97, 98 extend from the platform 96 through parallel holes in a block 99 to a face plate 100 permit the platform 96 to move in a first direction. A spring 102 urges the face plate 100 forward the block 99 and a first micrometer 104 having a threaded anvil extending through the face plate 100 to the block 99 allows accurate adjustment of the image 46 in the die 44 in the first direction. The block 99 is also slideable along a slide bar 106 to permit movement of the platform 96 and the image die 44 in a second direction perpendicular to the first direction. A plate 108 mounted on the base 14 has a threaded hole therein parallel to the axis of the slide bar 106 through which a second micrometer 110 is threaded. The distal end of the micrometer 110 contacts the surface of a contact plate 112 mounted on the face plate 100, and the plate 112 is urged toward the plate 108 by a spring 114. Adjustment of the second micrometer 110 will adjust the position of the image die 44 and the image 46 therein in the second direction.

While a single embodiment of the present invention has been depicted, it will be appreciated by those familiar with the art that many modifications and variations may be made without departing from the true spirit and scope of the invention. It is therefore the intent of the appended claims to cover all the modifications and variations which fall within the true spirit and scope of the invention.

What is claimed:

1. A device for applying coloring to a product comprising a plurality of print stations in side by side relationship, each said print station including an image die having a planar horizontal surface with a pattern of indentations therein for receiving a coloring material, said image die horizontally moveable from a first position to a second position, and means for applying a coloring material into said indentations of said image die while said image die is in said first position, a horizontally moveable carriage, said carriage linearly moveable in a first direction to any of said plurality of print stations, a print pad on said carriage, said print pad vertically moveable from an elevated position to a lowered position, cleaning means on said carriage for cleaning residue coloring material from said print pad, retaining means on said carriage for retaining a product, said print pad horizontally moveable to a first position with said print pad over said image die when said image die is in said second position, said print pad horizontally moveable to a second position with said print pad over said cleaning means, and said print pad horizontally moveable to a third position with said print pad over said retainer means.

2. The device for coloring a product in accordance with claim 1 wherein said print pad is linearly moveable between said first position, said second position, and said third position.

3. The device for coloring a product in accordance with claim 1 wherein said image die of one of said plurality of print stations is horizontally adjustable for positioning said pattern of indentations with respect to said print pad.

4. The device for applying coloring to a product according to claim 1 wherein said cleaning means further comprises a cleaning table, a spool of tape, indexing means for indexing the movement of a length of tape across said cleaning table prior to movement of said print pad to said second position.

5. The device for coloring a product in accordance with claim 1 and further comprising a slide on said carriage said slide moveable in a second direction perpendicular to said first direction, and said print pad mounted on said slide.

6. The device for coloring a product in accordance with claim 5 and further comprising first power means for moving said image die from said first position to said second position, second power means for moving said slide with said print pad thereon to said first position, said second position, and said third position, third power means for moving said print pad from said elevated position to said lowered position, fourth power means for moving said carriage to any of said plurality of print stations, and control means for controlling said first power means, said second power means, said third power means, and said fourth power means.

7. The device for applying coloring to a product in accordance with claim 6 wherein said control means controls said first power means, said second power means, said third power means, and said fourth power means to move said image die to said second position after a coloring material has been applied into said indentations of said image die by said means for applying a coloring material, move said print pad to said first position after said image die has been moved to said second position, move said print pad to said lowered position against said image die while said image die is in said second position and said slide is in said first position for applying coloring material to said print pad, move said slide to said third position after said coloring material has been applied to said print pad, move said print pad to said lowered position against said product in said retainer means while said slide is in said third position to apply said coloring material to said product, move said slide and said print pad to said second position after said coloring material has been applied to said product, move said print pad to said lowered position and against said cleaning means while said slide is in said second position and, move said image die to said first position after said coloring material has been applied to said print pad, and move said carriage to each of said plurality of print stations.

8. A device for applying coloring to a product comprising a first print station having a first image die with an indentation therein for receiving a coloring material and first means for applying coloring material in said indentation of said first image die, a second print station having a second image die with an indentation therein for receiving a coloring material and second means for applying coloring material in said indentation of said second image die, said first print station and said second print station in side by side relationship, a carriage moveable between said first print station and said second print station, a retaining means on said carriage said retaining means for retaining a product, a print pad on said carriage, said print pad moveable to a first position over said retaining means and to a second position over said first image die when said carriage is at said first print station and over said second image die when said carriage is at said second print station.

9. A device in accordance with claim 8 and further comprising a slide on said carriage, said slide moveable in a direction perpendicular to the movement of said carriage, and said print pad mounted on said slide.

10. A device in accordance with claim 9 and further comprising cleaning means mounted on said carriage for removing residue coloring material from said print pad, and said slide moveable to a first position wherein said print pad is in said first position over said retaining means, to a second position wherein said print pad is in said second position over one of said first and said second image die and to a third position wherein said print pad is over said cleaning means.

11. A device in accordance with claim 10 wherein said cleaning means is a spool of tape.

12. A device in accordance with claim 8 and further comprising a cleaning means on said carriage for removing residue coloring material from said print pad.

13. A device in accordance with claim 8 wherein first image die is horizontally adjustable for positioning a pattern of color applied to said product in said retaining means.

* * * * *